US009659516B2

(12) United States Patent
Yokonuma

(10) Patent No.: US 9,659,516 B2
(45) Date of Patent: May 23, 2017

(54) DRIVE DEVICE OF DISPLAY PANEL, DISPLAY DEVICE INCLUDING THE SAME, AND DRIVE METHOD OF DISPLAY PANEL

(71) Applicant: Sharp Kabushiki Kaisha, Osaka-shi, Osaka (JP)

(72) Inventor: Shinsuke Yokonuma, Osaka (JP)

(73) Assignee: Sharp Kabushiki Kaisha, Sakai (JP)

( * ) Notice: Subject to any disclaimer, the term of this patent is extended or adjusted under 35 U.S.C. 154(b) by 149 days.

(21) Appl. No.: 14/376,153

(22) PCT Filed: Feb. 7, 2013

(86) PCT No.: PCT/JP2013/052806
§ 371 (c)(1),
(2) Date: Aug. 1, 2014

(87) PCT Pub. No.: WO2013/121957
PCT Pub. Date: Aug. 22, 2013

(65) Prior Publication Data

US 2015/0015620 A1 Jan. 15, 2015

(30) Foreign Application Priority Data

Feb. 14, 2012 (JP) ..... 2012-029106

(51) Int. Cl.
*G09G 3/20* (2006.01)
*G09G 3/36* (2006.01)

(52) U.S. Cl.
CPC ..... *G09G 3/2003* (2013.01); *G09G 3/3655* (2013.01); *G09G 3/3677* (2013.01);
(Continued)

(58) Field of Classification Search
CPC ... G09G 2300/0426; G09G 2310/0286; G09G 2310/0289; G09G 3/3648; G09G 2230/00
See application file for complete search history.

(56) References Cited

U.S. PATENT DOCUMENTS 6,232,939 B1 * 5/2001 Saito ..... G09G 3/3677 345/100
6,501,456 B1 12/2002 Saito et al.
(Continued)

FOREIGN PATENT DOCUMENTS

JP 11-237611 A 8/1999
JP 2002-202761 A 7/2002
(Continued)

OTHER PUBLICATIONS

Official Communication issued in International Patent Application No. PCT/JP2013/052806, mailed on Mar. 19, 2013.

*Primary Examiner* — Kent Chang
*Assistant Examiner* — Sujit Shah
(74) *Attorney, Agent, or Firm* — Keating & Bennett, LLP

(57) ABSTRACT

A drive device of a display panel includes a controller that controls operations of a scanning-control signal output circuit and a common-electrode voltage control circuit, wherein when the controller receives a changeover command that indicates changeover of a scanning order of a plurality of scanning signal lines, the controller controls an operation of the scanning-control signal output circuit so that a scanning order of the plurality of scanning signal lines is changed over between a normal order and a reverse order and controls an operation of the common-electrode voltage control circuit so that a voltage of the common electrode is changed over between a voltage determined in advance for normal-order scan and a voltage determined in advance for reverse-order scan, during a scanning order changeover period as a predetermined period after ending last scanning of a scanning signal line during a frame period in which the changeover command is received.

17 Claims, 14 Drawing Sheets

(52) U.S. Cl.
CPC ... *G09G 3/3696* (2013.01); *G09G 2310/0264* (2013.01); *G09G 2310/0283* (2013.01); *G09G 2320/046* (2013.01)

(56) References Cited

U.S. PATENT DOCUMENTS

| | | | | |
|---|---|---|---|---|
| 7,315,957 | B1 * | 1/2008 | Wagner | G06F 1/06 713/500 |
| 2004/0056833 | A1 | 3/2004 | Kitagawa et al. | |
| 2004/0108989 | A1 * | 6/2004 | Gyouten | G09G 3/3677 345/100 |
| 2006/0159217 | A1 * | 7/2006 | Harada | G11C 19/00 377/64 |
| 2010/0066923 | A1 * | 3/2010 | Imai | G09G 3/3648 348/792 |
| 2012/0120044 | A1 | 5/2012 | Mizunaga et al. | |

FOREIGN PATENT DOCUMENTS

| | | | | |
|---|---|---|---|---|
| JP | 2002202761 | A | * | 7/2002 |
| JP | 2004-117742 | A | | 4/2004 |
| JP | 2004-171732 | A | | 6/2004 |
| JP | 2006-201296 | A | | 8/2006 |
| JP | 2009-282474 | A | | 12/2009 |
| JP | 2009282474 | A | * | 12/2009 |
| WO | 2010/150562 | A1 | | 12/2010 |

* cited by examiner

Fig.4

| | |
|---|---|
| NORMAL-ORDER SCAN | 6.5V |
| REVERSE-ORDER SCAN | 7.0V |

Fig.5

| TERMINAL NUMBER | NORMAL-ORDER SCAN | REVERSE-ORDER SCAN |
|---|---|---|
| 1 | GSP1 | CLR4 |
| 2 | GSP2 | CLR3 |
| 3 | GSP3 | CLR2 |
| 4 | GSP4 | CLR1 |
| 5 | VSS (VGL) | VSS (VGL) |
| 6 | GCK1 | GCK4B |
| 7 | GCK1B | GCK4 |
| 8 | GCK2 | GCK3B |
| 9 | GCK2B | GCK3 |
| 10 | GCK3 | GCK2B |
| 11 | GCK3B | GCK2 |
| 12 | GCK4 | GCK1B |
| 13 | GCK4B | GCK1 |
| 14 | VSS (VGL) | VSS (VGL) |
| 15 | CLR1 | GSP4 |
| 16 | CLR2 | GSP3 |
| 17 | CLR3 | GSP2 |
| 18 | CLR4 | GSP1 |

60

DRIVE DEVICE OF DISPLAY PANEL, DISPLAY DEVICE INCLUDING THE SAME, AND DRIVE METHOD OF DISPLAY PANEL

TECHNICAL FIELD

The present invention relates to a drive device of a display panel, and particularly, relates to a drive device of a display panel capable of performing changeover (reversal) of a scanning order of gate bus lines (scanning signal lines).

BACKGROUND ART

In recent years, in order to realize miniaturization, cost reduction and the like of display devices, there have been progressed developments of display devices that have a display unit including pixel circuits and a gate driver for driving gate bus lines (scanning signal lines), formed on the same panel substrate. In such a display device, a gate driver is provided in the display panel. Therefore, such a display panel is called a GIP (Gate In Panel).

Regarding a display device that includes a GIP, a configuration that makes it possible to perform changeover (reversal) of a scanning order of gate bus lines is known. The changeover (reversal) of a scanning order is to perform changeover between normal-order scan of driving gate bus lines one by one from one end (an upper end, for example) of the display unit to the other end (a lower end, for example) of the display unit, and reverse-order scan of driving gate bus lines one by one from the other end of the display unit to the one end of the display unit. For example, in a display device that includes n gate bus lines as shown in FIG. 17, the gate bus lines are scanned in the order of "a first row, a second row, a third row, . . . , an (n−2)-th row, an (n−1)-th row, and an n-th row" in normal-order scan, and the gate bus lines are scanned in the order of "the n-th row, the (n−1)-th row, (n−2)-th row, . . . , the third row, the second row, and the first row" in reverse-order scan. It should be noted that to change over a scanning order between a normal order and a reverse order in this way will be hereinafter referred to as "scanning order reversal". With the display device that can perform such scanning order reversal, even when a television is installed by being hanged from the ceiling, for example, it becomes possible to enable viewers to watch an image in a correct direction, by performing of reverse-order scan.

It should be noted that, in relation to the present invention, Japanese patent Application Laid-Open No. 2004-117742 discloses an invention relating to a display device that can reduce bias current of an output buffer.

PRIOR ART DOCUMENT

Patent Document

[Patent Document 1] Japanese patent Application Laid-Open No. 2004-117742

SUMMARY OF THE INVENTION

Problems to be Solved by the Invention

The above scanning order reversal is generally performed based on a command from an external host of a display device. As for this, when reversal timing of the scanning order is attempted to be matched with a vertical blanking period, a processing load at a host side becomes large.

Therefore, scanning order reversal has been conventionally performed at an arbitrary timing. However, when scanning order reversal is performed at an arbitrary timing, mismatch occurs between a timing of a vertical scanning of a display panel and a changeover timing (a timing of changeover between a waveform for normal-order scan and a waveform for reverse-order scan) of a control signal (hereinafter, a "gate driver control signal") for controlling an operation of a gate driver. As a result, disturbance occurs in the display in some cases.

Further, due to a pixel structure, magnitudes of pull-in voltages (field-through voltages) are different between normal-order scan and reverse-order scan. Therefore, optimum opposing DC levels (magnitudes of a direct-current voltage of a common electrode in which a charging rate when charging of a positive polarity is performed and a charging rate when charging of a negative polarity is performed become equal) are different between normal-order scan and reverse-order scan. However, conventionally, a magnitude (a voltage value) of a direct-current voltage of a common electrode (hereinafter, simply referred to as a "common electrode voltage") has been set constant also in the display device that can perform scanning order reversal. Therefore, when reverse-order scan has been performed during a long period by scanning order reversal in a display device in which a value of a common electrode voltage has been determined based on an optimum opposing DC level in normal-order scan, for example, screen burn-in or an afterimage occurs in the display panel, due to the difference of the optimum opposing DC levels between normal-order scan and reverse-order scan.

Therefore, an object of the present invention is to provide a drive device, of a display panel capable of performing scanning order reversal, that can suppress occurrence of screen burn-in, an afterimage, or disturbance of display.

Means for Solving the Problems

A first aspect of the present invention is directed to a drive device of a display panel including a plurality of video signal lines, a plurality of scanning signal lines that intersect with the plurality of video signal lines, pixel electrodes provided respectively in a plurality of pixel formation portions arranged in a matrix corresponding to intersections between the plurality of video signal lines and the plurality of scanning signal lines, a common electrode provided to be oppose to the pixel electrodes in order to apply voltages to between the pixel electrodes and the common electrode, and a scanning signal line drive circuit that drives the plurality of scanning signal lines, the drive device comprising:

a scanning-control signal output unit that outputs a plurality of scanning control signals for controlling an operation of the scanning signal line drive circuit;

a common-electrode voltage control unit that controls a voltage of the common electrode; and a controller that controls operations of the scanning-control signal output unit and the common-electrode voltage control unit, wherein when the controller receives a changeover command that indicates changeover of a scanning order of the plurality of scanning signal lines, the controller controls an operation of the scanning-control signal output unit so that a scanning order of the plurality of scanning signal lines is changed over between a normal order and a reverse order and controls an operation of the common-electrode voltage control unit so that a voltage of the common electrode is changed over between a voltage determined in advance for normal-order scan and a voltage determined in advance for reverse-order scan, during a scanning order changeover period as a predetermined period after ending last scanning of a scanning signal line during a frame period in which the changeover command is received.

According to a second aspect of the present invention, in the first aspect of the present invention, the plurality of scanning control signals include a scanning start signal for starting scanning of the scanning signal lines and a scanning end signal for ending scanning of the scanning signal lines, and the scanning order changeover period is a period from a time point when the scanning end signal for ending last scanning of a scanning signal line during a frame period in which the controller receives the changeover command becomes non-active to a time point when the scanning start signal for starting scanning of a first scanning signal line during a next frame period becomes active.

According to a third aspect of the present invention, in the first aspect of the present invention, the scanning-control signal output unit has a plurality of output terminals for outputting the plurality of scanning control signals to the scanning signal line drive circuit, and the output terminals output different signals as the scanning control signals at a time when normal-order scan is performed and at a time when reverse-order scan is performed.

According to a fourth aspect of the present invention, in the third aspect of the present invention, the plurality of scanning control signals include a scanning start signal for starting scanning of the scanning signal lines and a scanning end signal for ending scanning of the scanning signal lines, from an output terminal that outputs the scanning start signal when normal-order scan is performed, the scanning end signal is output when reverse-order scan is performed, and from an output terminal that outputs the scanning end signal when normal-order scan is performed, the scanning start signal is output when reverse-order scan is performed.

According to a fifth aspect of the present invention, in the first aspect of the present invention, the plurality of scanning control signals include a plurality of clock signals for sequentially scanning the plurality of scanning signal lines, and the controller controls an operation of the scanning-control signal output unit so that drive of the plurality of clock signals is suspended during the scanning order changeover period.

According to a sixth aspect of the present invention, in the first aspect of the present invention, the plurality of scanning control signals include a plurality of clock signals for sequentially scanning the plurality of scanning signal lines, and the controller controls an operation of the scanning-control signal output unit so that waveforms of the plurality of clock signals are changed over between waveforms for normal-order scan and waveforms for reverse-order scan by changing a duty ratio of each clock signal during the scanning order changeover period.

According to a seventh aspect of the present invention, in the first aspect of the present invention, the controller receives one command having one argument, as the changeover command.

According to an eighth aspect of the present invention, in the first aspect of the present invention, at least one frame period is inserted, as the scanning order changeover period, between a frame period in which the controller receives the changeover command and a frame period in which next image data is to be written.

According to a ninth aspect of the present invention, in the eighth aspect of the present invention, two frame periods are inserted, as the scanning order changeover period, between a frame period in which the controller receives the changeover command and a frame period in which next image data is to be written, black color display or white color display is performed in the inserted two frame periods, and the controller controls an operation of the scanning-control signal output unit so that a scanning order of the plurality of scanning signal lines is changed over between a normal order and a reverse order and controls an operation of the common-electrode voltage control unit so that a voltage of the common electrode is changed over between a voltage determined in advance for normal-order scan and a voltage determined in advance for reverse-order scan, during a succeeding frame period out of the inserted two frame periods.

A tenth aspect of the present invention is directed to a display device comprising:

the drive device according to an first aspect of the present invention; and the display panel.

According to an eleventh aspect of the present invention, in the tenth aspect of the present invention, the pixel formation portion includes a thin-film transistor in which a control terminal is connected to the scanning signal line, a first conductive terminal is connected to the video signal line, a second conductive terminal is connected to the pixel electrode, and a channel layer is formed by an oxide semiconductor.

A twelfth aspect of the present invention is directed to a display device comprising the drive device according to the first aspect of the present invention and the display panel, wherein an electric charge period of a length of one frame period in which writing of image data is performed and a suspension period of a length of a plurality of frame periods in which writing of image data is suspended are alternately repeated, the pixel formation portion includes a thin-film transistor in which a control terminal is connected to the scanning signal line, a first conductive terminal is connected to the video signal line, a second conductive terminal is connected to the pixel electrode, and a channel layer is formed by an oxide semiconductor, the scanning order changeover period is two frame periods during the suspension period, black color display or white color display is performed during the two frame periods as the scanning order changeover period, the controller controls an operation of the scanning-control signal output unit so that scanning of the plurality of scanning signal lines is performed in a scanning order at a time point when the changeover command is received, during a preceding frame period out of the two frame periods as the scanning order changeover period, and the controller controls an operation the scanning-control signal output unit so that a scanning order of the plurality of scanning signal lines is changed over between a normal order and a reverse order and controls an operation of the common-electrode voltage control unit so that a voltage of the common electrode is changed over between a voltage determined in advance for normal-order scan and a voltage determined in advance for reverse-order scan, during a succeeding frame period out of the two frame periods as the scanning order changeover period.

According to a thirteenth aspect of the present invention, in the twelfth aspect of the present invention, a frame period next to two frame periods as the scanning order changeover period is the electric charge period.

A fourteenth aspect of the present invention is directed to a drive method of a display panel including a plurality of video signal lines, a plurality of scanning signal lines that intersect with the plurality of video signal lines, pixel electrodes provided respectively in a plurality of pixel formation portions arranged in a matrix corresponding to intersections between the plurality of video signal lines and the plurality of scanning signal lines, a common electrode provided to be oppose to the pixel electrodes in order to apply voltages to between the pixel electrodes and the common electrode, and a scanning signal line drive circuit that drives the plurality of scanning signal lines, the drive method comprising:

a command reception step of receiving a changeover command for indicating changeover of a scanning order of the plurality of scanning signal lines:

a timing adjustment step of measuring a timing from a time point when the changeover command is received in the command reception step to a scanning order changeover period as a predetermined period after ending last scanning of a scanning signal line during a frame period in which the changeover command is received; and a control step of controlling output of a plurality of scanning control signals for controlling an operation of the scanning signal line drive circuit and a voltage of the common electrode, wherein in the control step, during the scanning order changeover period, output of the plurality of scanning control signals is controlled so that a scanning order of the plurality of scanning signal lines is changed over between a normal order and a reverse order, and a voltage of the common electrode is changed over between a voltage determined in advance for normal-order scan and a voltage determined in advance for reverse-order scan.

Effects of the Invention

According to a first aspect of the present invention, in a display device that includes a display panel capable of performing changeover (reversal) of a scanning order of scanning signal lines, when a changeover command for indicating changeover of a scanning order has been given, changeover of a scanning order is performed after ending last scanning of a scanning signal line during a frame period in which the changeover command has been given. Therefore, changeover of scanning control signals and the like is not performed at an unsuitable timing such as during a vertical scanning of the display panel. Accordingly, occurrence of display disturbance due to changeover of a scanning order is suppressed.

According to a second aspect of the present invention, changeover of a scanning order is performed during a period from when drawing in a frame period in which a changeover command has been given ends to when drawing in a next frame period is started. Therefore, changeover of scanning control signals and the like are not performed during a drawing period. Accordingly, occurrence of display disturbance due to changeover of a scanning order is securely suppressed.

According to a third aspect of the present invention, in a display device having an output terminal that is configured to output scanning control signals which are different depending on a scanning order, occurrence of display disturbance due to changeover of a scanning order is suppressed.

According to a fourth aspect of the present invention, in a display device having an output terminal that is configured to output a scanning start signal or a scanning end signal depending on a scanning order, occurrence of display disturbance due to changeover of a scanning order is suppressed.

According to a fifth aspect of the present invention, drive of a clock signal is suspended during a scanning order changeover period. Therefore, occurrence of display disturbance due to changeover of a scanning order is suppressed while reducing of power consumption is achieved.

According to a sixth aspect of the present invention, a signal (a mask signal) for suspending the drive of a clock signal is not necessary. Therefore, design of a drive device becomes easy, and cost is reduced.

According to a seventh aspect of the present invention, in order to execute changeover of a scanning order, one command having one argument may be given to a drive device of a display panel. Therefore, changeover of a scanning order is performed without increasing a load of a host that gives a command to the drive device.

According to an eighth aspect of the present invention, as a scanning order changeover period, time of a length of at least one frame period is provided. Therefore, time for performing changeover of scanning control signals and changeover of common electrode voltages is secured sufficiently. Accordingly, even in a display device having a short vertical blanking period, changeover of a scanning order can be performed without causing display disturbance.

According to a ninth aspect of the present invention, two frame periods are provided as a scanning order changeover period, and either black color display or white color display is performed during the two frame periods. Therefore, changeover of a scanning order is not easily visually recognized by the viewers. Further, during the succeeding frame period out of the two frame periods, changeover of scanning control signals and changeover of common electrode voltages are performed. Therefore, like in the eighth aspect of the present invention, in a display device having a short vertical blanking period, changeover of a scanning order can be also performed without causing display disturbance.

According to a tenth aspect of the present invention, a display device that achieves effects similar to those in the first aspect of the present invention is realized.

According to an eleventh aspect of the present invention, as a thin-film transistor in a pixel formation portion, there is used a thin-film transistor that has a channel layer formed by an oxide semiconductor. Therefore, a voltage written in the pixel formation portion is held for a long time. Accordingly, in a display device having a display panel capable of performing changeover of a scanning order of scanning signal lines, it becomes possible to suppress occurrence of display disturbance due to changeover of a scanning order, while performing low-frequency drive.

According to a twelfth aspect of the present invention, in a display device that performs low-frequency drive, reversal of a scanning order is performed during a suspension period. Therefore, the suspension period can be used effectively.

According to a thirteenth aspect of the present invention, in a display device that performs low-frequency drive, when reversal of a scanning order has been performed, a next electric charge period is started, without waiting for an end of a suspension period of a predetermined length. Accordingly, images after reversal of a scanning order are quickly displayed.

According to a fourteenth aspect of the present invention, an effect similar to that in the first aspect of the present invention can be achieved in the invention of a drive method of a display panel.

BRIEF DESCRIPTION OF THE DRAWINGS

FIG. 4 is a diagram showing an example of a setting table of common electrode voltages, in the first embodiment.

FIG. 5 is a diagram showing an example of setting information of output terminals for gate driver control signals, in the first embodiment.

MODES FOR CARRYING OUT THE INVENTION

Hereinafter, embodiments of the present invention will be described with reference to appended drawings.

1. First Embodiment

1.1 Total Configuration and Operation Outline

Figure 2:
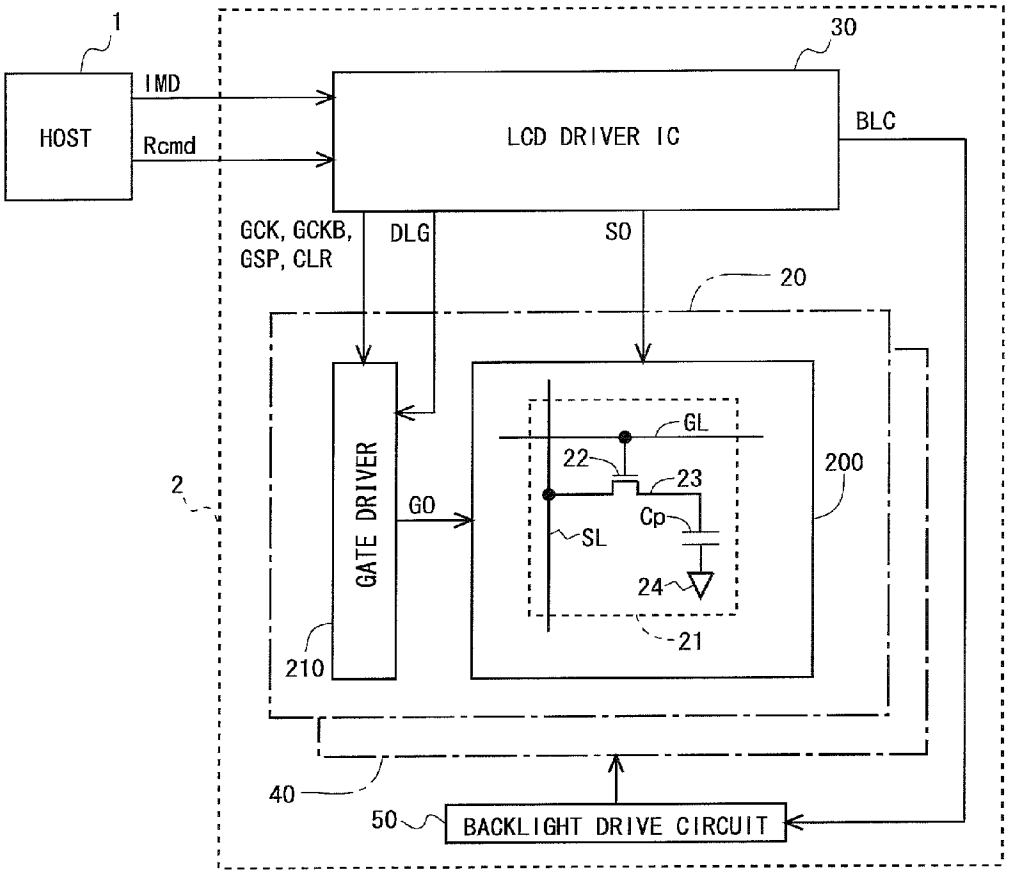
FIG. 2 is a block diagram showing a total configuration of the liquid crystal display device in the first embodiment.

FIG. 2 is a block diagram showing a total configuration of a liquid crystal display device 2 according to a first embodiment of the present invention. As shown in FIG. 2, the liquid crystal display device 2 includes a liquid-crystal display panel 20, an LCD driver IC 30 as a drive device for liquid-crystal display panel 20, a backlight 40, and a backlight drive circuit 50. The liquid-crystal display panel 20 includes a display unit 200, and a gate driver 210. That is, in the present embodiment, the gate driver 210 is directly formed on a panel substrate that constitutes the liquid-crystal display panel 20. Such a gate driver 210 is called a "monolithic gate driver". It should be noted that, outside the liquid crystal display device 2, a host 1 that is mainly configured by a CPU is provided.

The display unit 200 includes a plurality of source bus lines (video signal lines) SL, a plurality of gate bus lines (scanning signal lines) GL, and a plurality of pixel formation portions 21 corresponding respectively to intersections between the plurality of source bus lines SL and the plurality of gate bus lines GL. The plurality of pixel formation portions 21 are arranged in a matrix, and constitute a pixel array. Each of the pixel formation portions 21 includes: a TFT (thin-film transistor) 22 as a switching element that has a gate terminal connected to a gate bus line GL which passes through a corresponding intersection and that has a source terminal connected to a source bus line SL which passes through the intersection; a pixel electrode 23 that is connected to a drain terminal of the TFT 22; a common electrode 24 as an opposite electrode for giving a common potential to the plurality of pixel formation portions 21; and a liquid crystal layer that is provided in common to the plurality of pixel formation portions 21 and that is sandwiched between the pixel electrode 23 and the common electrode 24. Then, a liquid crystal capacitor that is formed by the pixel electrode 23 and the common electrode 24 configures a pixel capacitance Cp. Generally, in order to securely hold a voltage in the pixel capacitance Cp, an auxiliary capacitor is provided parallel to the liquid crystal capacitor. However, because the auxiliary capacitor is not directly related to the present invention, descriptions and drawings of the auxiliary capacitor will be omitted. It should be noted that, in the display unit 200 of FIG. 2, only constituent elements that correspond to one pixel formation portion 21 are shown. Hereinafter, the TFT 22 that is provided in the pixel formation portion 21 will also be referred to as a "pixel TFT".

The LCD driver IC 30 receives image data IMD that is transmitted from the host 1, generates gate clock signals GCK, GCKB, a gate start pulse signal GSP, a gate clear signal CLR, a source output signal SO, a backlight driving signal BLC, and a gate power supply DLG, and outputs them. The source output signal SO is applied to the source bus line SL. Upon receiving a reversal command Rcmd from the host 1, the LCD driver IC 30 performs a processing (scanning-order reversal processing) of changing over a scanning order of the gate bus lines GL between a normal order and a reverse order. Details of the reversal command Rcmd and the scanning-order reversal processing will be described later. It should be noted that various control data are also transmitted and received between the LCD driver IC 30 and the host 1. Description of the transmission and reception will be omitted. The transmission and reception of data between the host 1 and the LCD driver IC 30 are performed via an interface based on the DSI (Display Serial Interface) standard and proposed by the MIPI (Mobile Industry Processor Interface) Alliance. According to the interface based on the DSI standard, a high-speed data transmission becomes possible. In the present embodiment, a command mode of the interface based on the DSI standard is used.

The gate driver 210 repeats application of an active gate output signal (scanning signal) GO to each gate bus line GL at a predetermined cycle, based on the gate clock signals GCK and GCKB, the gate start pulse signal GSP, and the gate clear signal CLR (hereinafter, collectively referred to as a "gate driver control signal") that have been output from the LCD driver IC 30. It should be noted that, in the present embodiment, it is assumed that eight (eight-phase) signals GCK1 to GCK4 and GCK1B to GCK4B are used as gate clock signals, four signals GSP1 to GSP4 are used as gate start pulse signals, and four signals CLR1 to CLR4 are used as gate clear signals.

The backlight 40 is provided at a back surface side of the liquid-crystal display panel 20, and applies backlight beams to the back surface of the liquid-crystal display panel 20. The backlight 40 representatively includes a plurality of LEDs (Light Emitting Diodes).

The backlight drive circuit 50 outputs a signal (a current signal, for example) for controlling brightness of the LED, to the backlight 40, based on a backlight control signal BLC that has been output from the LCD driver IC 30. Specifically, a current value to be supplied to each LED in the backlight 40 is determined based on the backlight control signal BLC as a PWM (Pulse Width Modulation) signal. It should be noted that brightness of the plurality of LEDs in the backlight 40 may be individually controlled or may be uniformly controlled.

In the manner as described above, the source output signal SO is applied to the source bus line SL, the gate output signal GO is applied to the gate bus line GL, and the brightness of the LED in the backlight 40 is controlled by the backlight drive circuit 50. As a result, an image corresponding to the image data IMD transmitted from the host 1 is displayed in the display unit 200.

It should be noted that the scanning start signal is realized by the gate start pulse signal GSP, the scanning end signal is realized by the gate clear signal CLR, and the changeover command is realized by the reversal command Rcmd.

1.2 Configuration of LCD Driver IC

Figure 3:
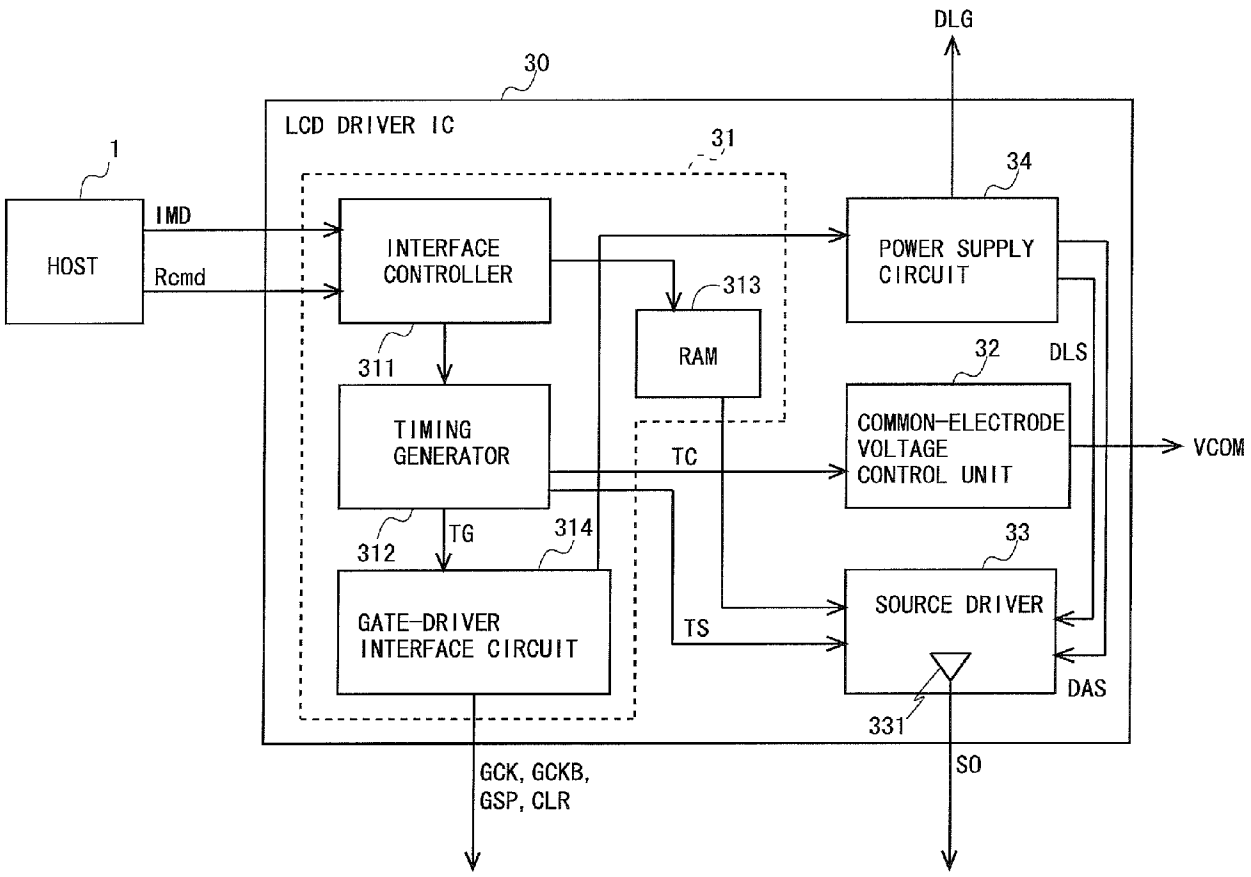
FIG. 3 is a block diagram showing a configuration of an LCD driver IC, in the first embodiment.

FIG. 3 is a block diagram showing a configuration of the LCD driver IC 30. The LCD driver IC 30 according to the present embodiment adapts to the command mode of the DSI standard as described above. As shown in FIG. 3, the LCD driver IC 30 includes a display control circuit 31, a power supply circuit 34, a common-electrode voltage control unit 32, and a source driver 33. It should be noted that a configuration of the LCD driver IC 30 adapting to the command mode of the DSI standard is not limited to the example shown in FIG. 3. Moreover, the source driver 33 may be provided outside the LCD driver IC 30. In this case, the source driver 33 may be formed integrally with the liquid-crystal display panel 20.

The display control circuit 31 includes an interface controller 311, a timing generator 312, a RAM (Random Access Memory) 313, and a gate-driver interface circuit 314. It should be noted that the interface controller 311 and the timing generator 312 realize a controller, and the gate-driver interface circuit 314 realizes a scanning-control signal output unit.

The interface controller 311 is based on the DSI standard. The interface controller 311 receives the image data IMD that has been transmitted from the host 1, and writes the image data IMD into the RAM 313. At the same time, the interface controller 311 transmits a panel-drawing start signal to the timing generator 312. It should be noted that the interface controller 311 transmits the panel-drawing start signal to the timing generator 312 in a constant cycle, even when the interface controller 311 does not receive the image data IMD. Further, the interface controller 311 receives the reversal command Rcmd transmitted from the host, and controls the operation of the timing generator 312 so that a desired scanning-order reversal processing is performed.

The timing generator 312 controls operations of the gate-driver interface circuit 314, the common-electrode voltage control unit 32, and the source driver 33, based on the panel-drawing start signal that has been given by the interface controller 311. It should be noted that the timing generator 312 transmits control signals TG, TC, and TS to the gate-driver interface circuit 314, the common-electrode voltage control unit 32, and the source driver 33, respectively. Upon receiving an instruction for executing a scanning-order reversal processing from the interface controller 311, the timing generator 312 measures a timing to a time point of ending drawing (writing of image data to the pixel capacitance) during a frame period in which the reversal command Rcmd has been given, and controls operations of the gate-driver interface circuit 314, the common-electrode voltage control unit 32, and the source driver 33 so that scanning order reversal is performed after ending the drawing.

The gate-driver interface circuit 314 generates a gate driver control signal, based on the control signal TG transmitted from the timing generator 312, and outputs the generated gate driver control signal to the gate driver 210. It should be noted that, in the present embodiment, during the vertical blanking period, the gate driver control signal is not output from the gate-driver interface circuit 314.

The common-electrode voltage control unit 32 controls a voltage (a common electrode voltage VCOM) to be given to the common electrode 24, based on the control signal TC transmitted from the timing generator 312. In the present embodiment, a common electrode voltage for normal-order scan and a common electrode voltage for reverse-order scan are prepared in advance in accordance with a difference between an optimum opposing DC level in normal-order scan and an optimum opposing DC level in reverse-order scan. Values of these voltages have been written in a table provided in the LCD driver IC 30, for example, as shown in FIG. 4. In the example shown in FIG. 4, the common electrode voltage for normal-order scan has been set to 6.5 V, and the common electrode voltage for reverse-order scan has been set to 7.0 V.

The source driver 33 includes an output amplifier 331 for outputting a source output signal SO after shaping a waveform or after increasing a voltage. It should be noted that, although FIG. 3 shows only one output amplifier 331, actually, the output amplifiers 331 are provided by the same number as that of the source bus lines SL. The source driver 33 generates the source output signal SO, based on the control signal TS transmitted from the timing generator 312. Specifically, the source driver 33 reads the image data from the RAM 313, and causes a shift register, a sampling latch circuit, and the like, in the source driver 33, to be operated, based on a source start pulse signal, a source clock signal, and a latch strobe signal as the control signal TS. The source driver 33 generates the source output signal SO, by converting an obtained digital signal into an analog signal by a DA conversion circuit (inside the source driver 33). It should be noted that the source start pulse signal, the source clock signal, and the latch strobe signal may be generated in the source driver 33 in accordance with the control signal TS. The source output signal SO is applied to the source bus line SL, after a waveform is shaped or a voltage is increased by the output amplifier 331 in the source driver 33.

The power supply circuit 34 generates the source power supplies DAS, DLS, the gate power supply DLG, and the like, as a voltage obtained by increasing a voltage of the clock signal by a charge pump system, for example, based on the control signal transmitted from the gate-driver interface circuit 314. The source power supply DAS is an analog power supply (a high voltage) that is used in the DA conversion circuit, the output amplifier 331, and the like. The source power supply DLS is a logic power supply (two kinds of power supplies of a high level and a low level) that is used in the shift register and the sampling latch circuit in the source driver 33. Hereinafter, the source power supplies DAS and DLS will be referred to as an "analog source power supply" and a "logic source power supply", respectively. The gate power supply DLG is a logic power supply (two kinds of power supplies of a high level and a low level) that is used in the shift register and the like in the gate driver 210. The power supply circuit 34 supplies the analog source power supply DAS and the logic source power supply DLS to the source driver 33, and supplies the gate power supply DLG to the gate driver 210.

1.3 Scanning-Order Reversal Processing

Next, the scanning-order reversal processing according to the present embodiment will be described. In the present embodiment, as a command for indicating reversal of a scanning order, the reversal command Rcmd having the argument that indicates a scanning order is given from the host 1 to the LCD driver IC 30. In the description, it is assumed that when a value of the argument is "0", this indicates a "normal-order scan", and when a value of the argument is "1", this indicates "reverse-order scan". It should be noted that, for the reversal command Rcmd, an MADCTL command of MIPI I/F can be used, and a D7 parameter thereof can be used for the argument that indicates a scanning order, for example.

Figure 1:
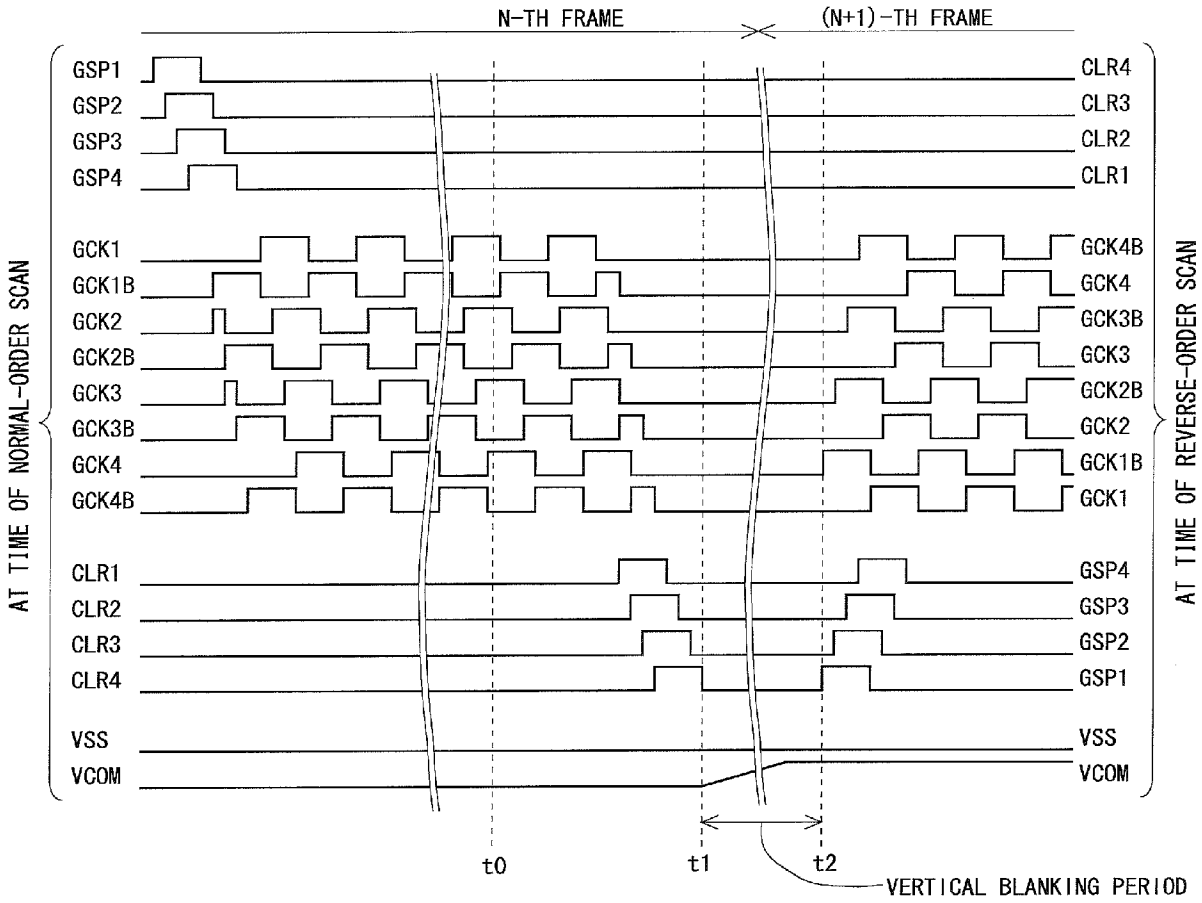
FIG. 1 is a signal waveform diagram for describing a scanning-order reversal processing in a liquid crystal display device according to a first embodiment of the present invention.

FIG. 1 is a signal waveform diagram for describing the scanning-order reversal processing according to the present embodiment. It is assumed here that the LCD driver IC 30 has received the reversal command Rcmd at a time point shown by a reference character t0 in FIG. 1 in a state that normal-order scan is being performed. In FIG. 1, waveforms of signals that are output from the output terminals are shown. Reference characters of signals that are allocated to the output terminals at a normal-order scan time are described at a left side of the waveforms, and reference characters of signals that are allocated to output terminals at a reverse-order scan time are described at a right side of the waveforms. That is, when a signal that is output from a certain output terminal of the LCD driver IC 30 is focused, the signal may function different roles at a normal-order scan time and at a reverse-order scan time. From FIG. 1, it is understood, for example, that the output terminal that outputs a signal which functions as a gate start pulse signal GSP1 at a normal-order scan time outputs a signal which functions as a gate clear signal CLR4 at a reverse-order scan time.

Hereinafter, a flow of the scanning-order reversal processing will be described. In an N-th frame, first, pulses of gate start pulse signals are generated in the order of "GSP1, GSP2, GSP3, and GSP4". Then, gate clock signals GCK1 to GCK4 and GCK1B to GCK4B appear in waveforms determined in advance for normal-order scan. Accordingly, the gate bus lines GL in the display unit 200 are scanned in a normal order. After the scanning of all gate bus lines GL ends, pulses of the gate clear signals are generated in the order of "CLR1, CLR2, CLR3, and CLR4. Accordingly, a shift register in the gate driver 210 becomes in a reset state. It should be noted that, even when the reversal command Rcmd is given at the time point t0, scanning of the gate bus lines GL in this frame (the N-th frame) is normally performed.

When the pulse of the gate clear signal CLR4 has completely fallen at a time point t1, the timing generator 312 outputs the control signal TG for indicating changeover of the gate driver control signals to the gate-driver interface circuit 314, and also outputs the control signal TC for indicating changeover of the common electrode voltage VCOM to the common-electrode voltage control unit 32. It should be noted that the time point t1 when the pulse of the gate clear signal CLR4 completely falls is a time point when the drawing in this frame ends.

Upon receiving the control signal TC from the timing generator 312 at the time point t1, the common-electrode voltage control unit 32 changes over the common electrode voltage VCOM from the voltage for normal-order scan to the voltage for reverse-order scan. However, an actual voltage value of the common electrode voltage VCOM gradually changes. It should be noted that it is sufficient that the common electrode voltage VCOM reaches the voltage for reverse-order scan by the time before starting the scanning of the gate bus line GL in an (n+1)-th frame.

Figure 6:
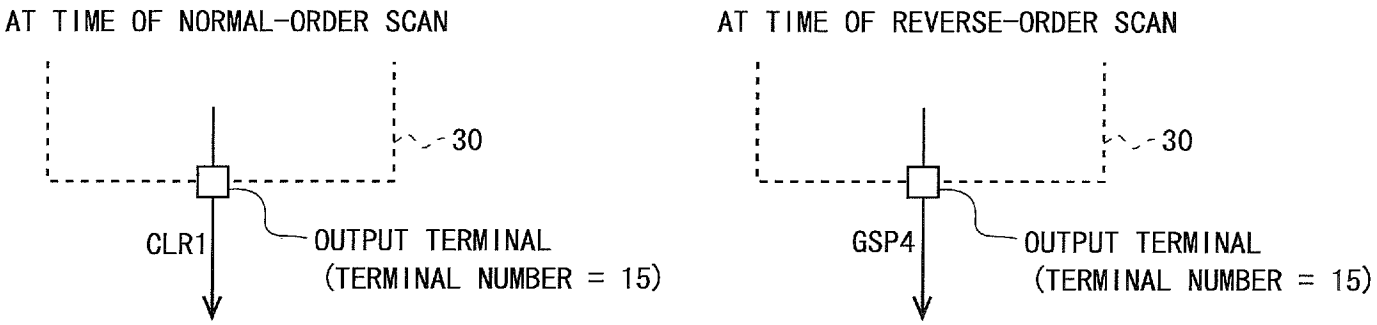
FIG. 6 is a diagram for describing a setting of output terminals for gate driver control signals, in the first embodiment.

Upon receiving the control signal TG from the timing generator 312 at the time point t1, the gate-driver interface circuit 314 changes over the output signals from the output terminals for the gate driver control signals that are provided in the LCD driver IC 30. This will be described in more detail. Generally, for the output terminals for gate driver control signals that are provided in the LCD driver IC 30, setting of signals to be output from certain output terminals is performed. With this, in the present embodiment, different settings are performed at a normal-order scan time and at a reverse-order scan time. In order to realize this, setting information as shown in FIG. 5 is held in the LCD driver IC 30. A row indicated by an arrow of a reference character 60 is focused in FIG. 5, for example. It is understood that "from the output terminal of a "terminal number=15", a gate clear signal CLR1 is output at a normal-order scan time, and a gate start pulse signal GSP4 is output at a reverse-order scan time" (see FIG. 6). Based on such setting information, setting of output terminals after scanning order reversal is performed. It should be noted that there may be output terminals that output the same signal at a normal-order scan time and at a reverse-order scan time, as indicated by "terminal number=5" and "terminal number=14". In the present example, although setting of output terminals is performed based on the setting information provided in the LCD driver IC 30, setting of output terminals may be performed by the host 1.

In the present embodiment, as shown in FIG. 1, drive of the gate driver control signals is suspended during a vertical blanking period. Therefore, it is during a period after the end time point of a vertical blanking period that the signals for reverse-order scan are output from the output terminals for the gate driver control signals of the LCD driver IC 30.

At a time point t2, the vertical blanking period ends, and drive of the gate driver control signal is started. Then, pulses of the gate start pulse signals are generated in the order of "GSP1, GSP2, GSP3, and GSP4". It should be noted that the gate start pulse signals GSP1, GSP2, GSP3, and GSP4 are output from the output terminals that have output the gate clear signals CLR4, CLR3, CLR2, and CLR1 at a normal-order scan time (the N-th frame), respectively. Further, the gate clock signals GCK1 to GCK4 and GCK1B to GCK4B appear in the waveforms determined in advance for reverse-order scan. Accordingly, the gate bus lines GL in the display unit 200 are scanned in a reverse order. It should be noted that the gate clock signals GCK1 to GCK4 and GCK1B to GCK4B are also output from different output terminals at a normal-order scan time and at a reverse-order scan time.

In the manner as described above, scanning order reversal from normal-order scan to reverse-order scan is performed. Scanning order reversal from reverse-order scan to normal-order scan is also similarly performed. It should be noted that, in the present embodiment, a scanning order change-over period is realized by the vertical blanking period.

Figure 7:
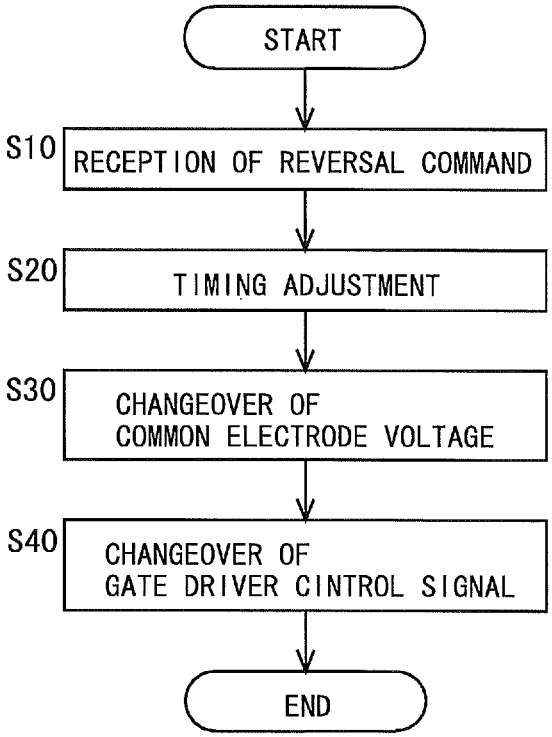
FIG. 7 is a flowchart for describing a flow of a scanning-order reversal processing, in the first embodiment.

The flow of the scanning-order reversal processing that is performed by the LCD driver IC 30 will be described again with reference to the flowchart shown in FIG. 7. First, when the reversal command Rcmd has been transmitted from the host 1, the interface controller 311 receives the reversal command Rcmd (step S10). It should be noted that the processing at and after step S20 is performed, only when the value of the argument of the reversal command Rcmd indicates a scanning order which is different from the scanning order at the present time point.

Figure 8:
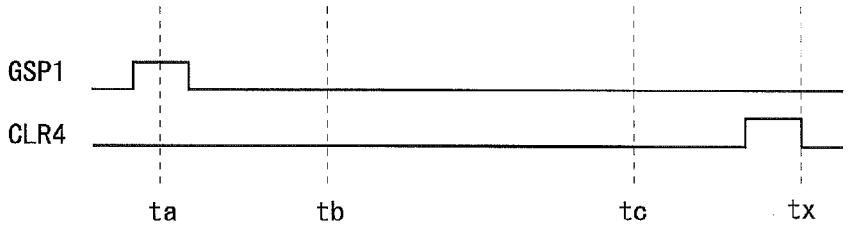
FIG. 8 is a diagram for describing a timing adjustment by a timing generator, in the first embodiment.

When the value of the argument of the reversal command Rcmd indicates a scanning order which is different from the scanning order at the present time point, the timing generator 312 measures timing from when the reversal command Rcmd is given to when the pulse of the gate clear signal CLR4 completely falls (step S20). By performing the processing of measuring a timing in this way, even when the reversal command Rcmd is received at any time point indicated by reference characters ta, tb, and tc in FIG. 8, for example, changeover of the common electrode voltage VCOM and changeover of the gate driver control signal are not performed till a time point indicated by a reference character tx. Accordingly, change of a voltage value of the common electrode voltage VCOM and changeover of the gate driver control signal are suppressed until the drawing in the current frame ends.

After scanning of all the gate bus lines GL in the display unit 200 have ended and after the pulse of the gate clear signal CLR4 has fallen completely, changeover of the common electrode voltage VCOM is performed by the common-electrode voltage control unit 32 (step S30), and changeover of the gate driver control signal is performed by the gate-driver interface circuit 314 (step S40). It should be noted that the "changeover of the gate driver control signal" is to perform changeover of signals that are output from the output terminals, as described above.

In the manner as described above, reversal of a scanning order is performed during the vertical blanking period. During a frame period next to the frame period in which the reversal command Rcmd has been given, an image is displayed while the gate bus lines GL are scanned in the scanning order after the reversal. It should be noted that a command reception step is realized by step S10, a timing adjustment step is realized by step S20, and a control step is realized by step S30 and step S40.

Figure 9:
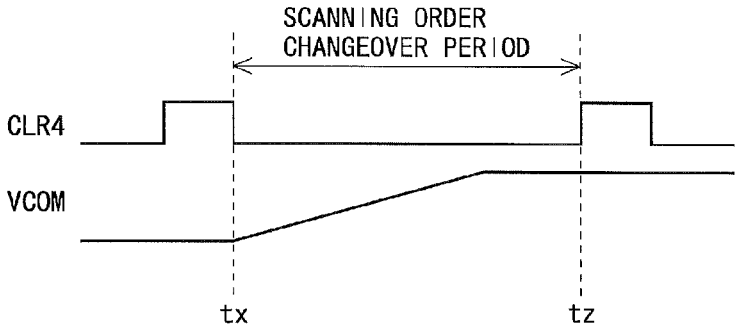
FIG. 9 is a diagram for describing changeover of common electrode voltages, in the first embodiment.
Figure 10:
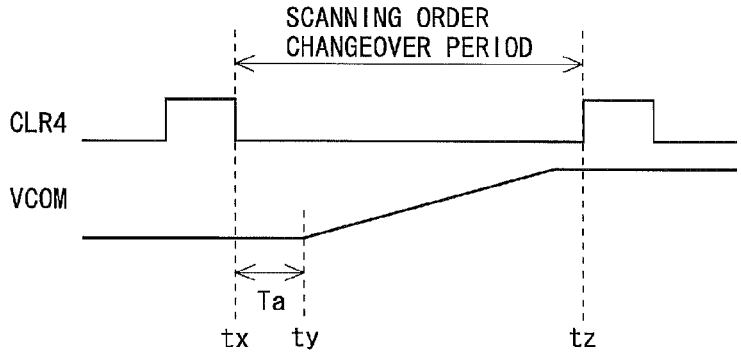
FIG. 10 is a diagram for describing changeover of common electrode voltages, in the first embodiment.

In the present embodiment, as shown in FIG. 9, by performing changeover of the common electrode voltage VCOM at the time point tx when the pulse of the gate clear signal CLR4 has completely risen, the actual voltage value of the common electrode voltage VCOM has changed from the time point tx. However, the present invention is not limited to this. As long as the actual voltage value of the common electrode voltage VCOM reaches a predetermined voltage value by the scanning start time point of the gate bus lines GL during the next frame period, the configuration may be such that changeover of the common electrode voltage VCOM is performed at a time point ty after a lapse of a predetermined period Ta from the time point tx when the pulse of the gate clear signal CLR4 has completely fallen, as shown in FIG. 10.

It should be noted that, when the reversal command Rcmd has been given during a period after the time point of the fall of the pulse of the gate clear signal CLR4 which is a period within the N-th frame, changeover of the gate driver control signal and changeover of the common electrode voltage VCOM may be performed as described above, after the pulse of the gate clear signal CLR4 has completely fallen in the (N+1)-th frame.

1.4 Effects

According to the present embodiment, in the liquid crystal display device 2 that includes the liquid-crystal display panel 20 which can perform changeover (reversal) of a scanning order of the gate bus lines GL, when the reversal command Rcmd of the scanning order has been transmitted from the host 1, changeover of the gate driver control signal is performed after a time point when the pulse of the gate clear signal CLR4 has completely fallen during a frame period in which the reversal command Rcmd has been transmitted. That is, changeover of the gate driver control signal is performed after ending the drawing during the frame period in which the reversal command Rcmd has been given. Therefore, changeover of the gate driver control signal is not performed at an unsuitable timing during the vertical scanning of the liquid-crystal display panel 20 and the like. Accordingly, occurrence of display disturbance due to scanning order reversal can be suppressed.

Further, according to the present embodiment, the scanning-order reversal processing is performed based on one command having one argument. As for this, conventionally, in order to perform the setting of an output terminal, it has been necessary that the host issues a command for canceling a lock for access limit that is being performed by the LCD driver IC, and the host further issues a command for setting an address corresponding to each output terminal after canceling the lock. Further, conventionally, when it is attempted to match a reversal timing of a scanning order with a vertical blanking period, a processing load at the host side becomes large. On the other hand, according to the present embodiment, because it is sufficient that the host issues one command having one argument, the scanning-order reversal processing is performed without increasing the load of the host.

Further, according to the present embodiment, at the time of the scanning-order reversal processing, the common electrode voltage VCOM is changed over between a voltage for normal-order scan and a voltage for reverse-order scan. Therefore, at both a normal-order scan time and at a reverse-order scan time, a voltage value of the common electrode voltage VCOM can be set according to respective optimum opposing DC levels. Accordingly, occurrence of screen burn-in and an afterimage in the display panel due to the difference of the optimum opposing-DC levels between normal-order scan and reverse-order scan is suppressed.

1.5 Modification

Figure 11:
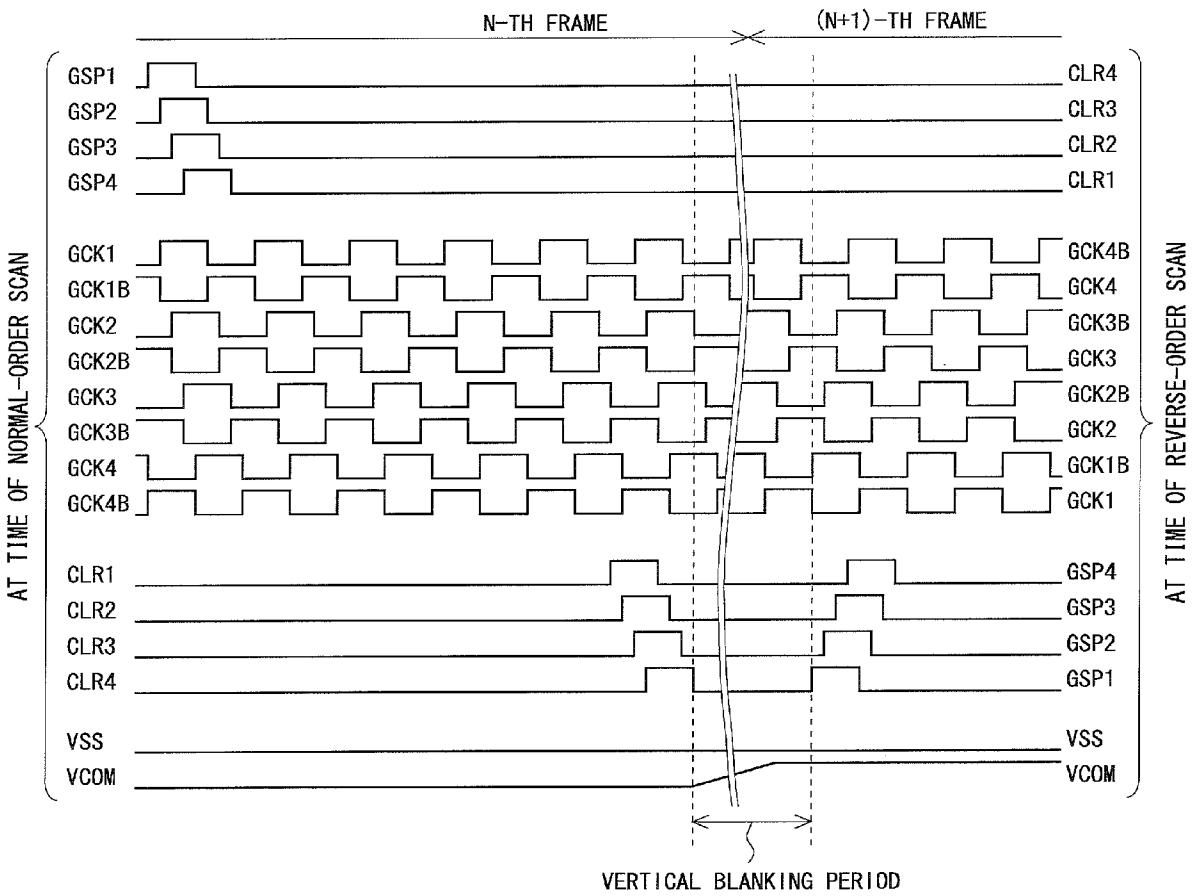
FIG. 11 is a signal waveform diagram for describing a scanning-order reversal processing in a modification of the first embodiment.

In the first embodiment, drive of the gate clock signals GCK1 to GCK4 and GCK1B to GCK4B is suspended during the vertical blanking period. However, the present invention is not limited to this. Concerning the gate clock signals GCK1 to GCK4 and GCK1B to GCK4B, changeover may be performed between the waveform for normal-order scan and the waveform for reverse-order scan without suspending the drive during the vertical blanking period as shown in FIG. 11.

In the present modification, the timing generator 312 controls the operation of the gate-driver interface circuit 314 so that changeover is performed between the waveform for normal-order scan and the waveform for reverse-order scan by changing duty ratios of the gate clock signals GCK1 to GCK4 and GCK1B to GCK4B during the vertical blanking period.

Figure 12:
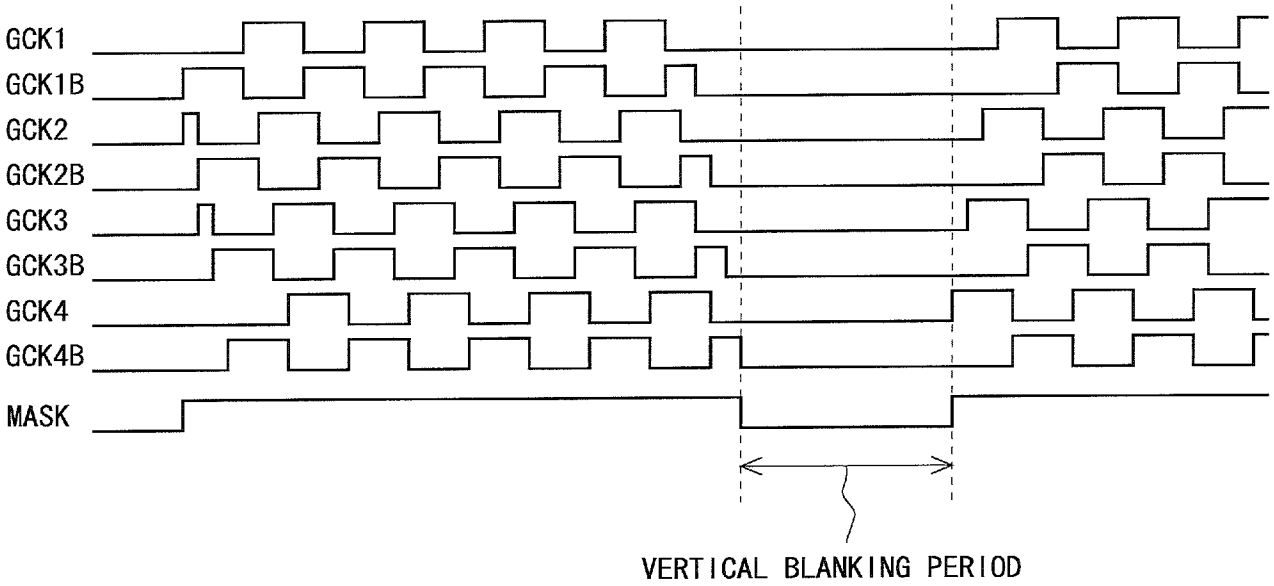
FIG. 12 is a diagram for describing an effect of the modification of the first embodiment.

Generally, in order to suspend the drive of gate clock signals during a vertical blanking period, a mask signal for controlling the drive of gate clock signals is used. For example, the LCD driver IC 30 is configured to be permitted to output active gate clock signals only when the logic level of the mask signal MASK is a high level. In such a configuration, the logic level of the mask signal MASK is set to a low level during the vertical blanking period as shown in FIG. 12. With this arrangement, the drive of the gate clock signals is suspended during the vertical blanking period. As described above, generally, a mask signal becomes necessary for suspending the drive of the gate clock signals. In this respect, according to the present modification, a mask signal for suspending the drive of the gate clock signals during the vertical blanking period becomes unnecessary. Therefore, as compared with the first embodiment, designing of the LCD driver IC 30 becomes easy. As a result, cost can be reduced.

2. Second Embodiment

2.1 Total Configuration and the Like

A second embodiment of the present invention will be described. A total configuration and a configuration of the LCD driver IC 30 are similar to those of the first embodiment, and therefore, their descriptions will be omitted (see FIGS. 2 and 3).

2.2 Scanning-Order Reversal Processing

Figure 13:
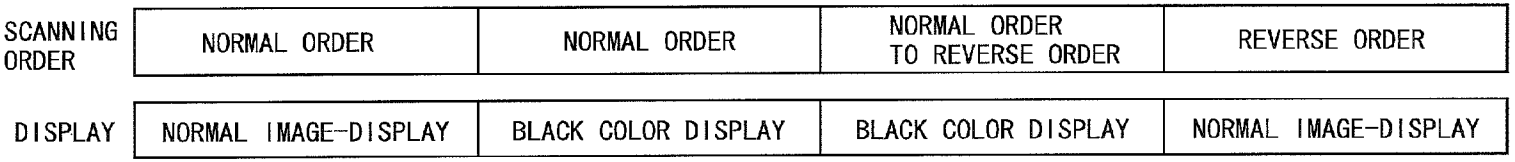
FIG. 13 is a diagram for describing a scanning-order reversal processing in a second embodiment of the present invention.
Figure 14:
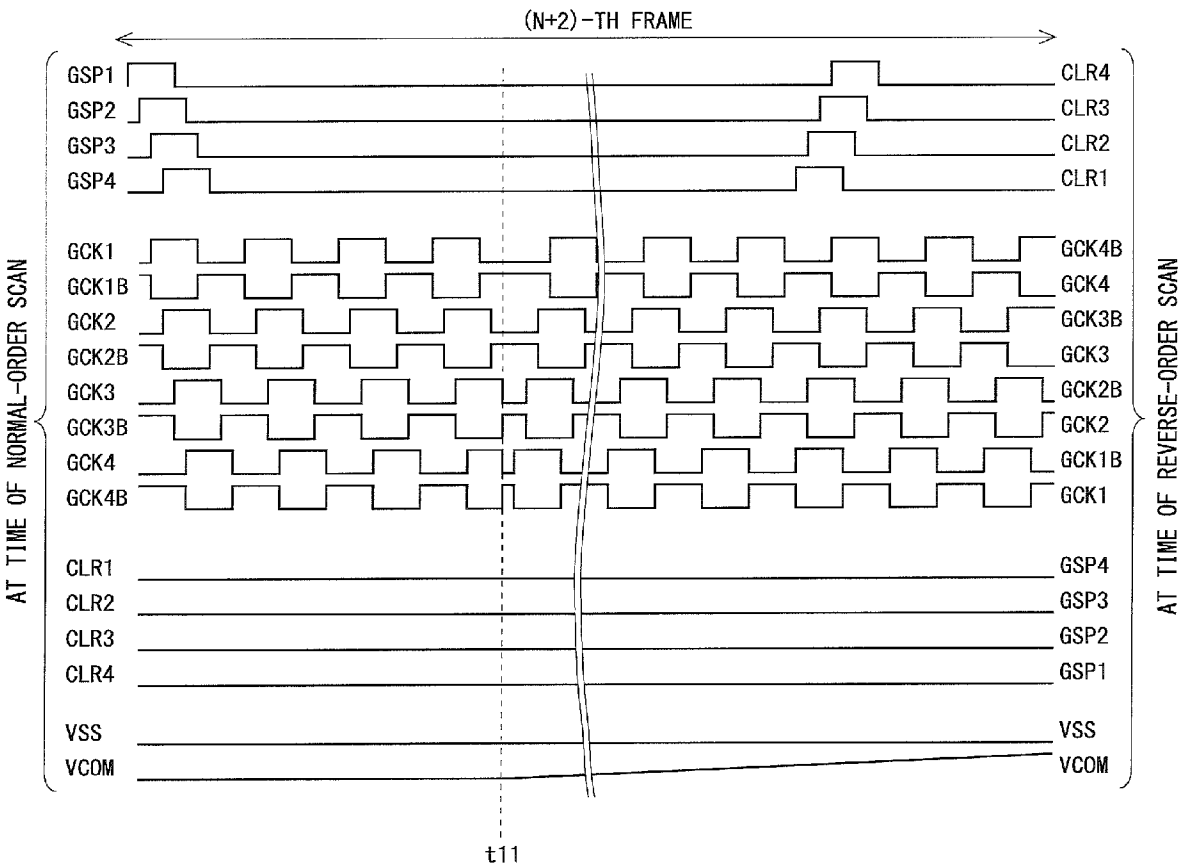
FIG. 14 is a signal waveform diagram for describing the scanning-order reversal processing in the second embodiment.

Next, with reference to FIG. 13, a flow of an operation of the liquid crystal display device 2 when the reversal command Rcmd has been transmitted from the host 1 to the LCD driver IC 30 will be described. In the present embodiment, when the reversal command Rcmd has been given in a certain frame period, two frame periods for performing a scanning-order reversal processing are inserted between the frame period and an original next frame period. FIG. 13 shows an example of a case where the reversal command Rcmd has been given in the N-th frame in which normal-order scan is being performed. In this case, after the normal image-display is performed in the N-th frame, black color display is performed by normal-order scan in the (N+1)-th frame. The reason why the black color display is performed in this way is to prevent changeover of a scanning order from being visually recognized. Waveforms of signals in the N-th frame and the (N+1)-th frame are similar to the waveforms in the N-th frame in FIG. 1. In the (N+2)-th frame, black color display is performed in a similar manner to that in the (N+1)-th frame. However, as shown in FIG. 14, changeover of the gate driver control signal and changeover of the common electrode voltage VCOM are performed in the (N+2)-th frame. In the example shown in FIG. 14, changeover of the gate driver control signal and changeover of the common electrode voltage VCOM are performed at a time point t11. It should be noted that the common electrode voltage VCOM gradually changes from a voltage for positive polarity to a voltage for negative polarity. Thereafter, the normal image-display is performed by reverse-order scan, in the (N+3)-th frame. Waveforms of signals in the (N+3)-th frame are similar to the waveforms in the (N+1)-th frame in FIG. 1. Scanning order reversal from reverse-order scan to normal-order scan is also similarly performed. It should be noted that, in the present embodiment, a scanning order changeover period is realized by the (N+1)-th frame and the (N+2)-th frame.

As described above, according to the present embodiment, two frame periods for performing a scanning-order reversal processing are inserted between two continuous frame periods for the normal image-display. Then, during the inserted two frame periods, black color display is performed. During the succeeding frame period out of the two frame periods, changeover of the gate driver control signal and changeover of the common electrode voltage VCOM are performed. It should be noted that, although black color display is performed in the N-th frame and the (N+1)-th frame in the above example, the configuration may be such that white color display is performed during the two frame periods. Although effects become small from the viewpoint of making changeover of a scanning order not easily visually recognizable, it is also possible to insert only a frame corresponding to the (N+2)-th frame out of the (N+1)-th frame and the (N+2)-th frame.

2.3 Effects

According to the present embodiment, two frame periods for performing reversal of a scanning order are inserted between two frame periods in which the normal image-display is performed. Black color display is performed during the preceding frame period out of the inserted two frame periods. Therefore, changeover of a scanning order is not easily visually recognized by the viewers. Further, during the succeeding frame period out of the inserted two frame periods, changeover of the gate driver control signal and changeover of the common electrode voltage VCOM are performed. That is, changeover of the gate driver control signal and changeover of the common electrode voltage VCOM can be performed during one frame period. Therefore, reversal of a scanning order can be performed without causing display disturbance, also in the liquid crystal display device having a short vertical blanking period.

3. Third Embodiment

3.1 Total Configuration and the Like

A third embodiment of the present invention will be described. A total configuration and a configuration of the LCD driver IC 30 are similar to those of the first embodiment, and therefore, their descriptions will be omitted (see FIGS. 2 and 3).

3.2 Pixel TFT and Low-Frequency Drive

Conventionally, reduction of power consumption in a display device such as a liquid crystal display device has been demanded. Therefore, there has been proposed a drive method of a display device, for providing a period (a suspension period) for suspending refresh of a screen by setting all gate bus lines to a non-scan state, after a period (an electric charge period) of refreshing the screen by scanning the gate bus lines. Such a drive method is called "low-frequency drive" and the like. Further, in recent years, a thin-film transistor that uses an oxide semiconductor for a channel layer (hereinafter, an "oxide TFT") has been focused. The oxide TFT has an extremely small off-leak current (a current that flows at an off-state time), as compared with a thin-film transistor that uses amorphous silicon for a channel layer (hereinafter, a "silicon system TFT"). Therefore, in the display device that uses the oxide TFT as an element in the display panel, a voltage that has been written to the pixel capacitance can be held for a relatively long time. Accordingly, the low-frequency drive is employed, particularly in the display device that uses the oxide TFT as the element in the display panel in this way. However, there is also a case where the low-frequency drive is employed in the display device that uses a silicon system TFT as the element in the display panel.

In the liquid crystal display device 2 according to the present embodiment, the oxide TFT is used as a pixel TFT 22. More specifically, a channel layer of the pixel TFT 22 is formed by IGZO (InGaZnOx) that has indium (In), gallium (Ga), zinc (Zn), and oxygen (O), as main components. Hereinafter, a TFT that uses IGZO for the channel layer will be called an "IGZO-TFT". A similar effect is also obtained when an oxide semiconductor that contains at least one of indium, gallium, zinc, copper (Cu), silicon (Si), tin (Sn), aluminum (Al), calcium (Ca), germanium (Ge), and lead (Pb), for example, as an oxide semiconductor other than IGZO, is used for the channel layer.

Figure 15:
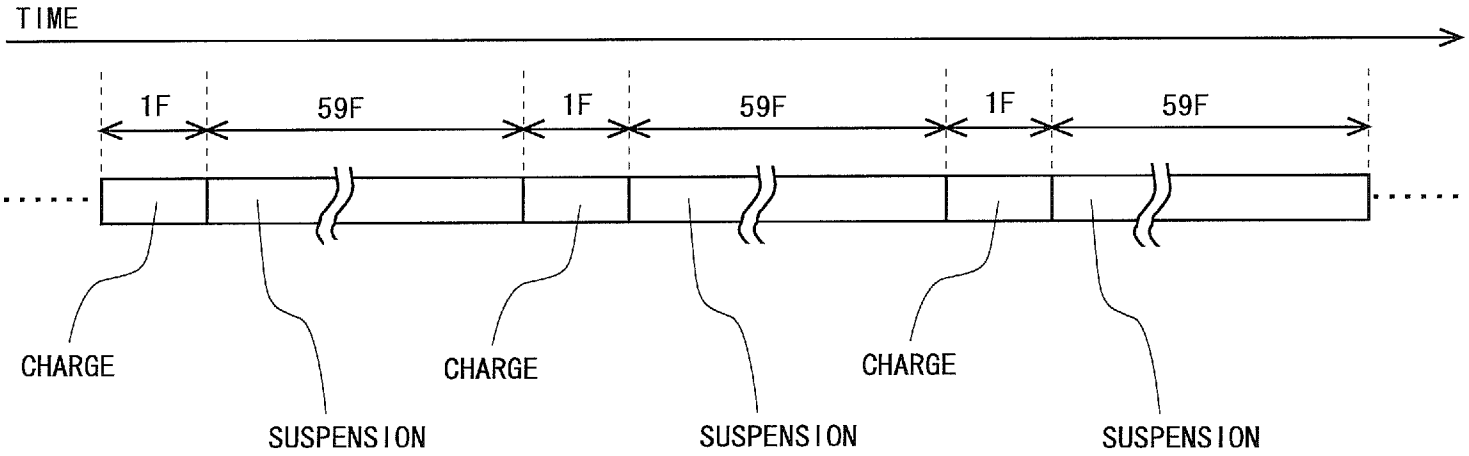
FIG. 15 is a diagram for describing drive during a normal time in a third embodiment of the present invention.

FIG. 15 is a view for explaining drive at the normal time in the present embodiment. As shown in FIG. 15, in the present embodiment, an electric charge period having the same length as one frame (one frame is 16.67 ms) in a general display device that has a refresh rate (drive frequency) of 60 Hz and a suspension period of 59 frames appear alternately. In this way, in the liquid crystal display device 2 according to the present embodiment, low-frequency drive is performed. It should be noted that, during the suspension period, output of the gate driver control signal from the gate-driver interface circuit 314 (see FIG. 3) is suspended.

3.3 Scanning-Order Reversal Processing

Figure 16:
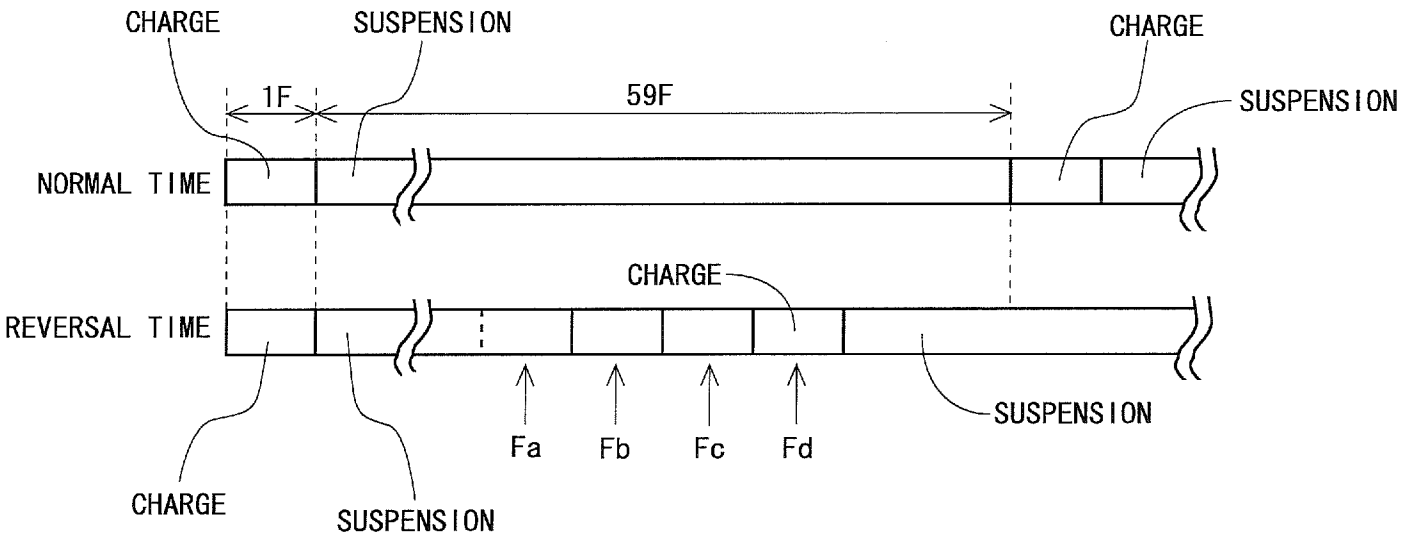
FIG. 16 is a diagram for describing a scanning-order reversal processing in the third embodiment.
Figure 17:
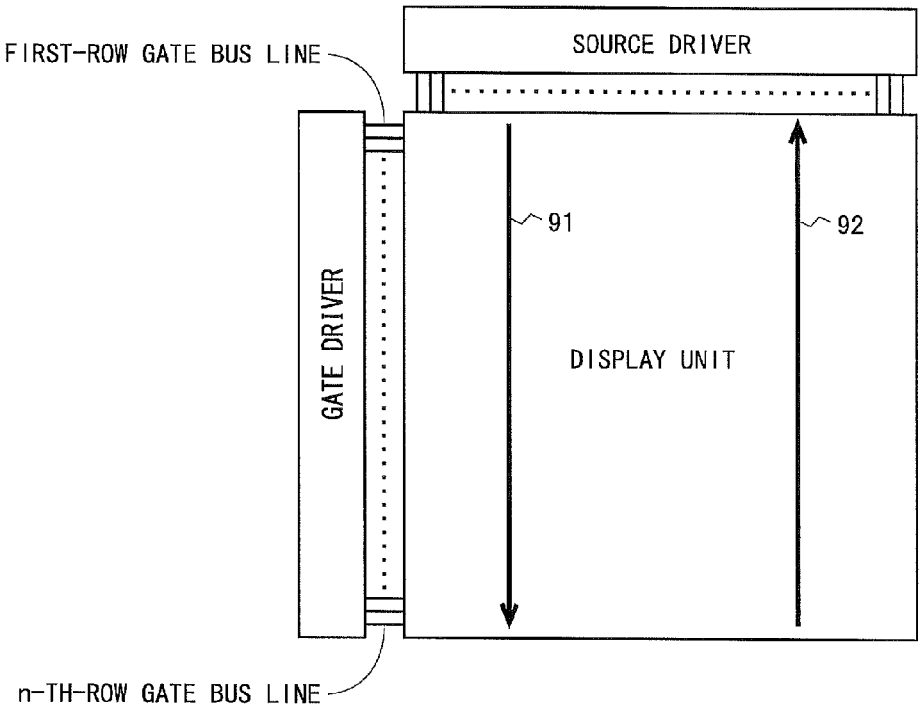
FIG. 17 is a diagram for describing changeover (reversal) of a scanning order.

Next, the scanning-order reversal processing according to the present embodiment will be described, with reference to FIG. 16. It is assumed that the reversal command Rcmd has been transmitted from the host 1 to the LCD driver IC 30 during a frame period indicated by a reference character Fa (hereinafter, a "frame Fa") in FIG. 16. It is also assumed that normal-order scan is being performed during an electric charge period until the reversal command Rcmd is given.

When the reversal command Rcmd has been given in the frame Fa as a suspension period, a state that the output of the gate driver control signal from the gate-driver interface circuit 314 is suspended is maintained in the frame Fa. In a frame Fb (a frame period next to the frame Fa), the gate driver control signal is output from the gate-driver interface circuit 314. At this time, a waveform of the gate driver control signal is the waveform for normal-order scan. In the frame Fb, black color display is performed in a state that normal-order scan is performed in this way. That is, the frame Fb corresponds to the (N+1)-th frame (see FIG. 13) in the second embodiment.

In a frame Fc, black color display is performed in a similar manner to that in the frame Fb. In the frame Fc, changeover of the gate driver control signal and changeover of the common electrode voltage VCOM are performed in a similar manner to that in the (N+2)-th frame in the second embodiment. That is, in the frame Fc, changeover of the gate driver control signal from a waveform for normal-order scan to a waveform for reverse-order scan is performed, and change of the common electrode voltage VCOM from a voltage for normal-order scan to a voltage for reverse-order scan is performed.

In a frame Fd, regardless of originally a suspension period, normal image-display is performed in a state that reverse-order scan has been performed. Specifically, in the frame Fd, the LCD driver IC 30 performs an interruption processing of shifting a driving state of the liquid-crystal display panel 20 from the suspension period to the electric charge period. In this way, in the present embodiment, when scanning order reversal has been performed, a next electric charge period is started, without waiting for end of the suspension period of a predetermined length. It should be noted that, in the present embodiment, the scanning order changeover period is realized in the frame Fb and the frame Fc.

Scanning order reversal from reverse-order scan to normal-order scan is also similarly performed. When the reversal command Rcmd has been given in the suspension period (58th and 59th frames, in the example shown in FIG. 15) which is a slightly before the electric charge period, the above processing may be performed by assuming that the reversal command Rcmd has been given in the electric charge period, or frames may be inserted like in the second embodiment.

3.4 Effects

According to the present embodiment, in the liquid crystal display device 2 that performs a low-frequency drive, a scanning-order reversal processing is performed in a suspension period. Therefore, the suspension period can be used effectively. When reversal of a scanning order has been performed, a next electric charge period is started, without waiting for end of the suspension period of a predetermined length. Accordingly, in the liquid crystal display device 2 that performs a low-frequency drive, an image after reversal of a scanning order is quickly displayed in the display unit 200.

4. Others

In the above description, an IGZO-TFT is employed as the pixel TFT 22 in only the third embodiment. However, the IGZO-TFT can be also employed in the first embodiment and the second embodiment. Further, in all embodiments, a TFT such as a silicon system TFT other than the IGZO-TFT can be employed as the pixel TFT 22.

In the above embodiments, a liquid crystal display device has been described as an example. However, the present invention is not limited this. The present invention can be also applied to other display device such as an organic EL (Electro Luminescence).

Further, in the above embodiments, the description is made on the assumption that an interface based on the DSI standard is used as the interface between the host 1 and the LCD driver IC 30. However, the present invention is not limited to this. For example, an interface based on the MDDI (Mobile Display Digital Interface) and the like may be also used as the interface. Further, it is possible to modify the above embodiments within a range not deviating from the gist of the present invention and implement it.

DESCRIPTION OF REFERENCE CHARACTERS

1: HOST
2: LIQUID CRYSTAL DISPLAY DEVICE
20: LIQUID-CRYSTAL DISPLAY PANEL
21: PIXEL FORMATION PORTION
22: PIXEL TFT
30: LCD DRIVER IC (DRIVE DEVICE)
31: DISPLAY CONTROL CIRCUIT
32: COMMON-ELECTRODE VOLTAGE CONTROL UNIT
200: DISPLAY UNIT
210: GATE DRIVER (SCANNING SIGNAL LINE DRIVE CIRCUIT)
311: INTERFACE CONTROLLER
312: TIMING GENERATOR
313: RAM
314: GATE-DRIVER INTERFACE CIRCUIT
IMD: IMAGE DATA
GSP, AND GSP1 TO GSP4: GATE START PULSE SIGNAL (SCANNING START SIGNAL)
GCK, GCK1 TO GCK4, AND GCK1B TO GCK4B: GATE CLOCK SIGNAL
CLR, AND CLR1 TO CLR4: GATE CLEAR SIGNAL (SCANNING END SIGNAL)
Rcmd: REVERSAL COMMAND
VCOM: COMMON ELECTRODE VOLTAGE

The invention claimed is:

1. A drive device of a display panel including a plurality of video signal lines, a plurality of scanning signal lines that cross the plurality of video signal lines, a plurality of pixel electrodes respectively in a plurality of pixel formation portions arranged in a matrix corresponding to a crossing of the plurality of video signal lines and the plurality of scanning signal lines, a common electrode opposed to the pixel electrodes to apply voltages between the pixel electrodes and the common electrode, and a scanning signal line drive circuit to drive the plurality of scanning signal lines, the drive device comprising:

a scanning-control signal output circuit to output a plurality of scanning control signals to control an operation of the scanning signal line drive circuit;

a common-electrode voltage control circuit to control a voltage of the common electrode; and a controller to control an operation of the scanning-control signal output circuit and the common-electrode voltage control circuit, wherein the plurality of scanning control signals include a plurality of clock signals including a plurality of gate clock signals to sequentially scan the plurality of scanning signal lines, wherein when the controller receives a changeover command that indicates changeover of a scanning order of the plurality of scanning signal lines, the controller controls an operation of the scanning-control signal output circuit so that a scanning order of the plurality of scanning signal lines is changed over between a normal order and a reverse order and controls an operation of the common-electrode voltage control circuit so that a voltage of the common electrode is changed over between a voltage determined in advance for normal-order scan and a voltage determined in advance for reverse-order scan, during a scanning order changeover period as a predetermined period after ending a last scanning of a scanning signal line during a frame period in which the changeover command is received, and the controller controls an operation of the scanning-control signal output circuit so that waveforms of the plurality of clock signals are changed over between waveforms for normal-order scan and waveforms for reverse-order scan by changing a duty ratio of each of the plurality of gate clock signals during the scanning order changeover period.

2. The drive device according to claim 1, wherein the plurality of scanning control signals include a scanning start signal for starting scanning of the scanning signal lines and a scanning end signal for ending scanning of the scanning signal lines, and the scanning order changeover period is a period from a time point when the scanning end signal for ending last scanning of a scanning signal line during a frame period in which the controller receives the changeover command becomes non-active to a time point when the scanning start signal for starting scanning of a first scanning signal line during a next frame period becomes active.

3. The drive device according to claim 1, wherein the scanning-control signal output circuit has a plurality of output terminals for outputting the plurality of scanning control signals to the scanning signal line drive circuit, and the output terminals output different signals as the scanning control signals at a time when normal-order scan is performed and at a time when reverse-order scan is performed.

4. The drive device according to claim 3, wherein the plurality of scanning control signals include a scanning start signal for starting scanning of the scanning signal lines and a scanning end signal for ending scanning of the scanning signal lines, from an output terminal that outputs the scanning start signal when normal-order scan is performed, the scanning end signal is output when reverse-order scan is performed, and from an output terminal that outputs the scanning end signal when normal-order scan is performed, the scanning start signal is output when reverse-order scan is performed.

5. The drive device according to claim 1, wherein the controller receives one command, as the changeover command.

6. The drive device according to claim 1, wherein a frame period is inserted, as the scanning order changeover period, between a frame period in which the controller receives the changeover command and a frame period in which next image data is to be written.

7. The drive device according to claim 6, wherein two frame periods are inserted, as the scanning order changeover period, between a frame period in which the controller receives the changeover command and a frame period in which next image data is to be written, a black color display or a white color display is displayed in the inserted two frame periods, and the controller controls an operation of the scanning-control signal output circuit so that a scanning order of the plurality of scanning signal lines is changed over between a normal order and a reverse order and controls an operation of the common-electrode voltage control circuit so that a voltage of the common electrode is changed over between a voltage determined in advance for normal-order scan and a voltage determined in advance for reverse-order scan, during a succeeding frame period out of the inserted two frame periods.

8. A display device comprising:

the drive device according to claim 1; and the display panel.

9. The display device according to claim 8, wherein the pixel formation portion includes a thin-film transistor in which a control terminal is connected to the scanning signal line, a first conductive terminal is connected to the video signal line, a second conductive terminal is connected to the pixel electrode, and a channel layer is formed by an oxide semiconductor.

10. A display device comprising the drive device according to claim 1 and the display panel, wherein an electric charge period of a length of one frame period in which writing of image data is performed and a suspension period of a length of a plurality of frame periods in which writing of image data is suspended are alternately repeated, the pixel formation portion includes a thin-film transistor in which a control terminal is connected to the scanning signal line, a first conductive terminal is connected to the video signal line, a second conductive terminal is connected to the pixel electrode, and a channel layer includes an oxide semiconductor, the scanning order changeover period is two frame periods during the suspension period, a black color display or a white color display is displayed during the two frame periods as the scanning order changeover period, the controller controls an operation of the scanning-control signal output circuit so that scanning of the plurality of scanning signal lines is performed in a scanning order at a time point when the changeover command is received, during a preceding frame period out of the two frame periods as the scanning order changeover period, and the controller controls an operation the scanning-control signal output circuit so that a scanning order of the plurality of scanning signal lines is changed over between a normal order and a reverse order and controls an operation of the common-electrode voltage control circuit so that a voltage of the common electrode is changed over between a voltage determined in advance for normal-order scan and a voltage determined in advance for reverse-order scan, during a succeeding frame period out of the two frame periods as the scanning order changeover period.

11. The display device according to claim 10, wherein a frame period next to two frame periods as the scanning order changeover period is the electric charge period.

12. A drive method of a display panel including a plurality of video signal lines, a plurality of scanning signal lines that cross the plurality of video signal lines, a plurality of pixel electrodes respectively in a plurality of pixel formation portions arranged in a matrix corresponding to a crossing of the plurality of video signal lines and the plurality of scanning signal lines, a common electrode opposed to the pixel electrodes to apply voltages between the pixel electrodes and the common electrode, and a scanning signal line drive circuit to drive the plurality of scanning signal lines, the drive method comprising:

receiving a changeover command for indicating changeover of a scanning order of the plurality of scanning signal lines;

measuring a timing from a time point when the changeover command is received to a scanning order changeover period as a predetermined period after ending a last scanning of a scanning signal line during a frame period in which the changeover command is received; and controlling output of a plurality of scanning control signals to control an operation of the scanning signal line drive circuit and a voltage of the common electrode, wherein the plurality of scanning control signals include a plurality of clock signals including a plurality of gate clock signals to sequentially scan the plurality of scanning signal lines, while controlling output of the plurality of scanning control signals, during the scanning order changeover period, output of the plurality of scanning control signals is controlled so that a scanning order of the plurality of scanning signal lines is changed over between a normal order and a reverse order, and a voltage of the common electrode is changed over between a voltage determined in advance for normal-order scan and a voltage determined in advance for reverse-order scan, and output of the plurality of scanning control signals is controlled so that waveforms of the plurality of clock signals are changed over between waveforms for normal-order scan and waveforms for reverse-order scan by changing a duty ratio of each of the plurality of gate clock signals during the scanning order changeover period.

13. A display device comprising a display panel and a drive device of the display panel, wherein an electric charge period of a length of one frame period in which writing of image data is performed and a suspension period of a length of a plurality of frame periods in which writing of image data is suspended are alternately repeated, the display panel includes a plurality of video signal lines, a plurality of scanning signal lines that cross the plurality of video signal lines, a plurality of pixel electrodes respectively in a plurality of pixel formation portions arranged in a matrix corresponding to a crossing of the plurality of video signal lines and the plurality of scanning signal lines, a common electrode opposed to the pixel electrodes to apply voltages between the pixel electrodes and the common electrode, and a scanning signal line drive circuit to drive the plurality of scanning signal lines, the drive device comprises:

a scanning-control signal output circuit to output a plurality of scanning control signals to control an operation of the scanning signal line drive circuit;

a common-electrode voltage control circuit to control a voltage of the common electrode; and a controller to control an operation of the scanning-control signal output circuit and the common-electrode voltage control circuit, when the controller receives a changeover command that indicates changeover of a scanning order of the plurality of scanning signal lines, the controller controls an operation of the scanning-control signal output circuit so that a scanning order of the plurality of scanning signal lines is changed over between a normal order and a reverse order and controls an operation of the common-electrode voltage control circuit so that a voltage of the common electrode is changed over between a voltage determined in advance for normal-order scan and a voltage determined in advance for reverse-order scan, during a scanning order changeover period as a predetermined period after ending a last scanning of a scanning signal line during a frame period in which the changeover command is received, wherein each of the plurality of pixel formation portions includes a thin-film transistor in which a control terminal is connected to the scanning signal line, a first conductive terminal is connected to the video signal line, a second conductive terminal is connected to the pixel electrode, and a channel layer includes an oxide semiconductor, the scanning order changeover period is two frame periods during the suspension period, a black color display or a white color display is displayed during the two frame periods as the scanning order changeover period, the controller controls an operation of the scanning-control signal output circuit so that scanning of the plurality of scanning signal lines is performed in a scanning order at a time point when the changeover command is received, during a preceding frame period out of the two frame periods as the scanning order changeover period, the controller controls an operation the scanning-control signal output circuit so that a scanning order of the plurality of scanning signal lines is changed over between a normal order and a reverse order and controls an operation of the common-electrode voltage control circuit so that a voltage of the common electrode is changed over between a voltage determined in advance for normal-order scan and a voltage determined in advance for reverse-order scan, during a succeeding frame period out of the two frame periods as the scanning order changeover period, the plurality of scanning control signals include a plurality of clock signals including a plurality of gate clock signals, and the controller controls an operation of the scanning-control signal output circuit so that waveforms of the plurality of clock signals are changed over between waveforms for normal-order scan and waveforms for reverse-order scan by changing a duty ratio of each of the plurality of gate clock signals during the scanning order changeover period.

14. The display device according to claim 13, wherein the scanning-control signal output circuit includes a plurality of output terminals that output the plurality of scanning control signals to the scanning signal line drive circuit, and the plurality of output terminals output different signals as the scanning control signals at a time when normal-order scan is performed and at a time when reverse-order scan is performed.

15. The display device according to claim 14, wherein the plurality of scanning control signals include a scanning start signal for starting scanning of the scanning signal lines and a scanning end signal for ending scanning of the scanning signal lines, from an output terminal that outputs the scanning start signal when normal-order scan is performed, the scanning end signal is output when reverse-order scan is performed, and from an output terminal that outputs the scanning end signal when normal-order scan is performed, the scanning start signal is output when reverse-order scan is performed.

16. The display device according to claim 13, wherein the controller controls an operation of the scanning-control signal output circuit so that drive of the plurality of clock signals is suspended during the scanning order changeover period.

17. The display device according to claim 13, wherein the controller receives one command, as the changeover command.

* * * * *